US010294677B1

(12) United States Patent
Casey

(10) Patent No.: US 10,294,677 B1
(45) Date of Patent: May 21, 2019

(54) INTERLOCKING FLOOR DISPLAY SYSTEM

(71) Applicant: Timothy Casey, Aliso Viejo, CA (US)

(72) Inventor: Timothy Casey, Aliso Viejo, CA (US)

( * ) Notice: Subject to any disclaimer, the term of this patent is extended or adjusted under 35 U.S.C. 154(b) by 0 days.

(21) Appl. No.: 16/040,352

(22) Filed: Jul. 19, 2018

(51) Int. Cl.
*E04F 15/02* (2006.01)

(52) U.S. Cl.
CPC .. *E04F 15/02038* (2013.01); *E04F 15/02033* (2013.01); *E04F 2201/01* (2013.01)

(58) Field of Classification Search
CPC ..... G09F 19/228; G09F 2019/223; E04F 15/02044; E04F 15/02194; E04F 15/02458; E04F 2015/02055; E04F 2015/0205
See application file for complete search history.

(56) References Cited

U.S. PATENT DOCUMENTS 3,157,254 A * 11/1964 Spiselman ..... E04F 15/02452 404/37
3,236,018 A * 2/1966 Graham ..... B62D 25/20 52/675
3,298,153 A * 1/1967 Rolland ..... E04B 5/14 52/456
3,396,501 A * 8/1968 Tate ..... E04F 15/02405 52/263
4,999,964 A * 3/1991 Taylor ..... E04B 5/46 52/477
6,352,757 B1 * 3/2002 Kessler ..... A47L 23/24 15/215
6,637,161 B1 * 10/2003 Buchalter ..... E04F 15/02447 52/126.6
2001/0034987 A1 * 11/2001 Cooper ..... E04B 5/48 52/220.8
2013/0104464 A1 * 5/2013 Meyer ..... E04F 15/02405 52/126.6
2014/0237912 A1 * 8/2014 Kugler ..... E04F 15/02464 52/126.6

* cited by examiner

*Primary Examiner* — Christine T Cajilig
(74) *Attorney, Agent, or Firm* — Plager Schack LLP

(57) ABSTRACT

An interlocking floor display system including a border frame; a plurality of grid members positioned within the border frame and defining a grid with multiple grid sections; a panel frame secured into each grid section; a support panel secured within each panel frame; and a planar surface resting on top of the support panel, wherein the interlocking floor display system includes a tongue in groove interlocking system, eliminating the need for mechanical fasteners.

7 Claims, 6 Drawing Sheets

INTERLOCKING FLOOR DISPLAY SYSTEM

BACKGROUND

The embodiments described herein relate generally to flooring, and more particularly, to an interlocking floor display system.

Industries, such as the automotive industry, require a glass floor display system that is easy to install, safe, and affordable. However, conventional floor display systems come apart easily, make noises when they are walked upon, do not provide an anti-slip walking surface, and pose tripping hazards to the public. Moreover, the existing flooring systems are cumbersome and require mechanical fasteners for assembly thereof Therefore, what is needed is a floor display system that is quick and easy to install, while also being safe and affordable.

SUMMARY

Some embodiments of the present disclosure include an interlocking floor display system including a border frame; a plurality of grid members positioned within the border frame and defining a grid with multiple grid sections; a panel frame secured into each grid section; a support panel secured within each panel frame; and a planar surface resting on top of the support panel, wherein the interlocking floor display system includes a tongue in groove interlocking system, eliminating the need for mechanical fasteners.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
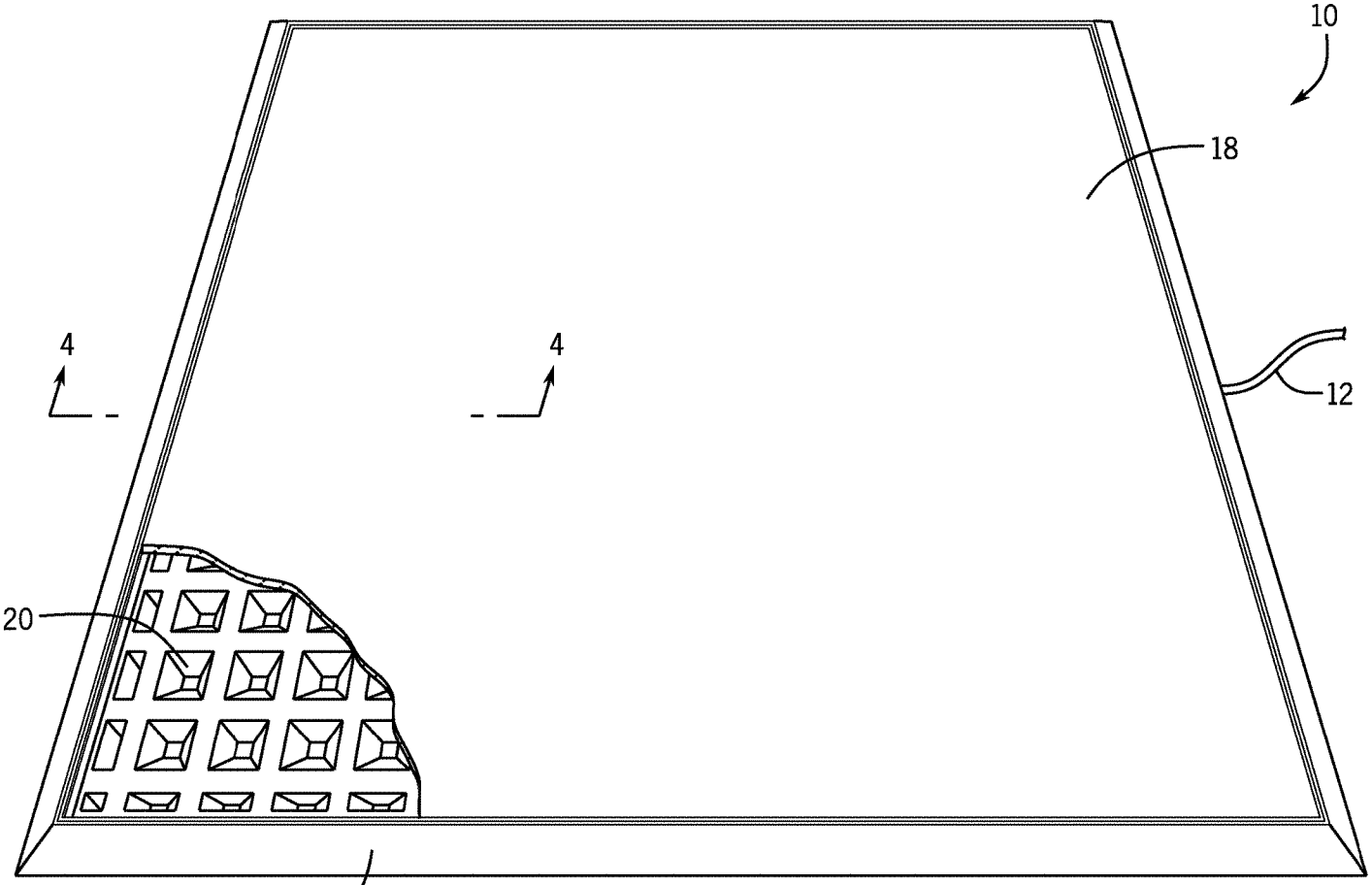
FIG. 1 is a top perspective view of one embodiment of the present disclosure.
Figure 2:
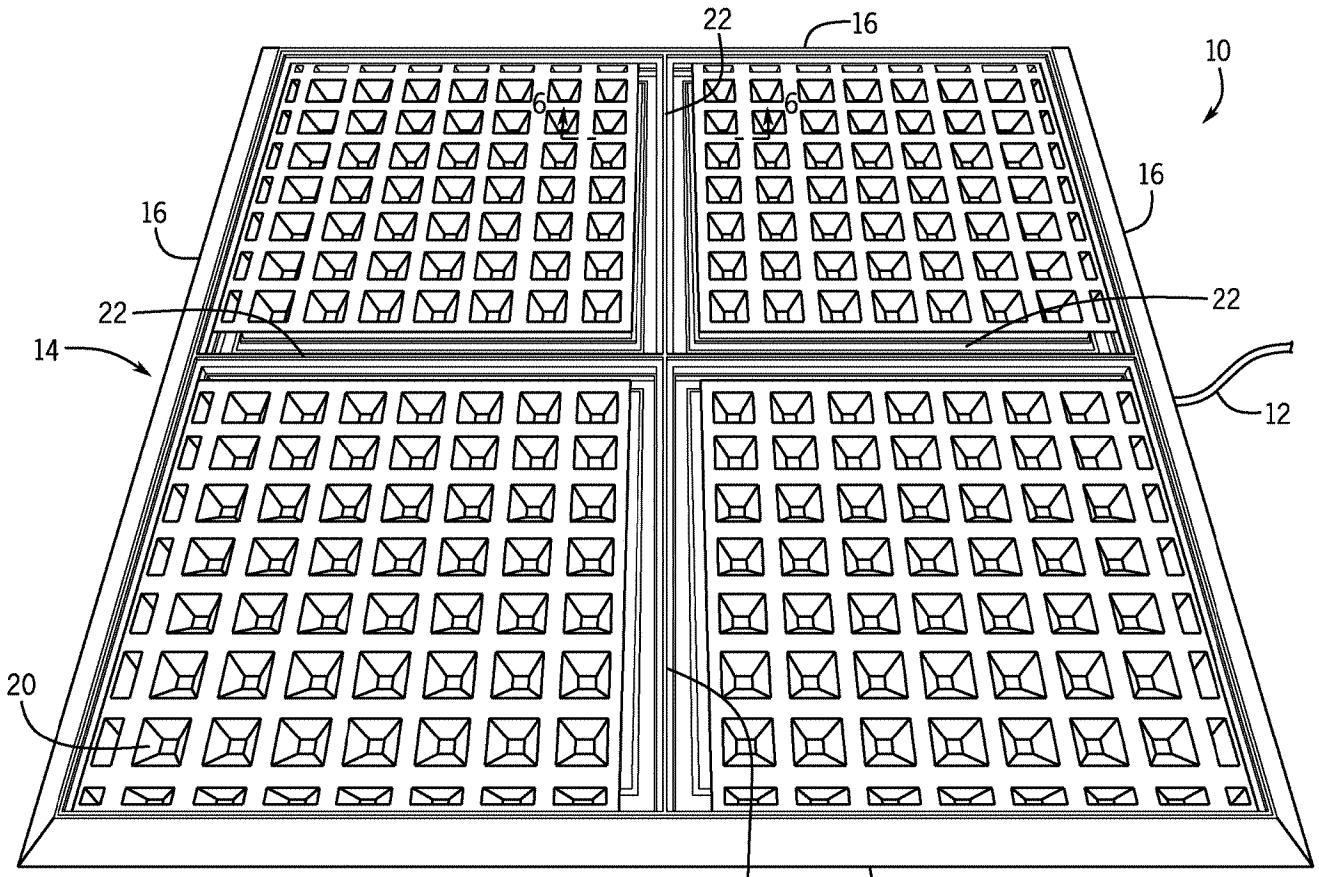
FIG. 2 is a top perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as an interlocking floor display system and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Border Frame
2. Grid Member
3. Panel Frame
4. Support Panel
5. Planar Surface The various elements of the device of the present disclosure may be related in the following exemplary fashion. It is not intended to limit the scope or nature of the relationships between the various elements and the following examples are presented as illustrative examples only.

By way of example, and referring to FIGS. 1-6, some embodiments of the present disclosure include an interlocking floor display system 10 comprising a border frame 14; a plurality of grid members 24 positioned within the border frame 14, defining a grid with multiple grid sections; a panel frame 22 secured into each grid section; a support panel 20 secured within each panel frame 22; and a planar surface 18 resting on top of the support panel 20, wherein the interlocking floor display system 10 includes a tongue in groove interlocking system, eliminating the need for mechanical fasteners.

Figure 3:
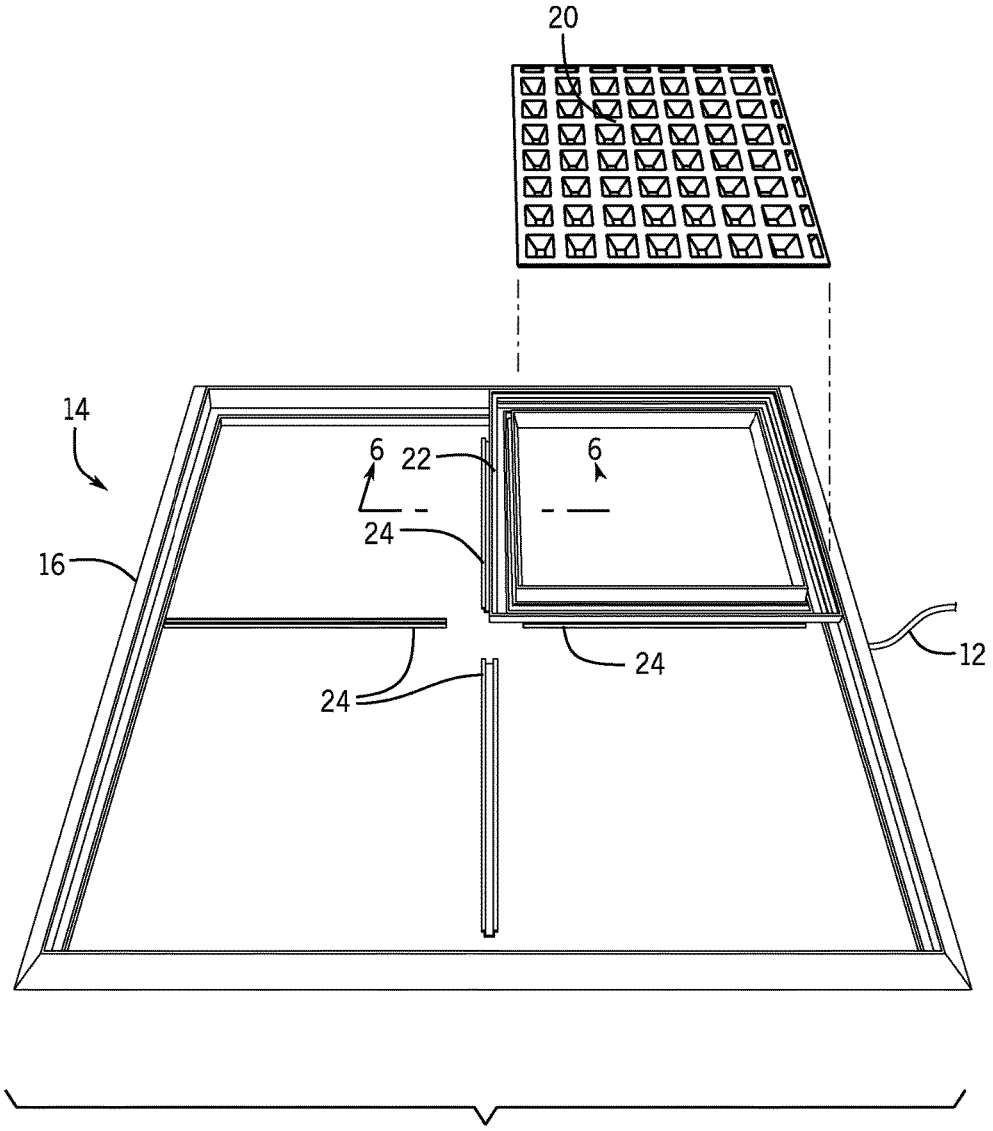
FIG. 3 is an exploded perspective view of one embodiment of the present disclosure.

As shown in the Figures, the border frame 14 may comprise a substantially square frame comprising four border frame members 16. However, other shapes are envisioned. Within each border frame 14, a grid may be formed by the placement of grid members 24. For example, as shown in FIG. 3, four grid members 24 may be placed within the border frame 14, wherein each grid member extends perpendicularly toward the center of the framed area from a central portion of its respective border frame member 16, thus forming four grid sections. As also shown in FIG. 3, a panel frame 22 engages with the border frame members 16 and grid members 24 to be secured within the grid section. The support panel 20 may then be placed onto the panel frame 22, wherein the structure of the support panel 20 is designed to engage with the structure of the panel frame 22 to lock the support panel 20 into place.

Figure 4:
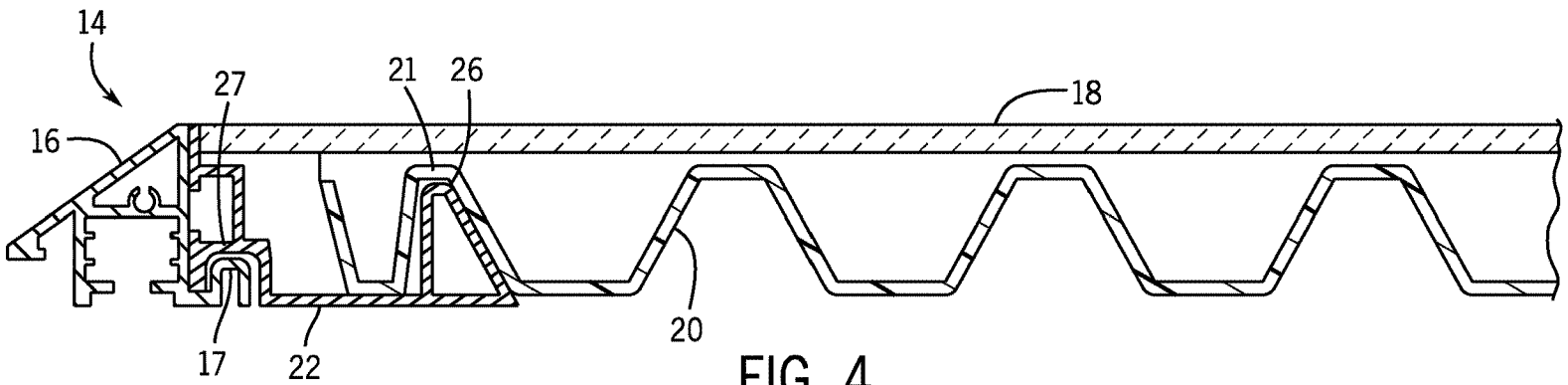
FIG. 4 is a cross-sectional view of one embodiment of the present disclosure, taken along line 4-4 in FIG. 1.
Figure 5:
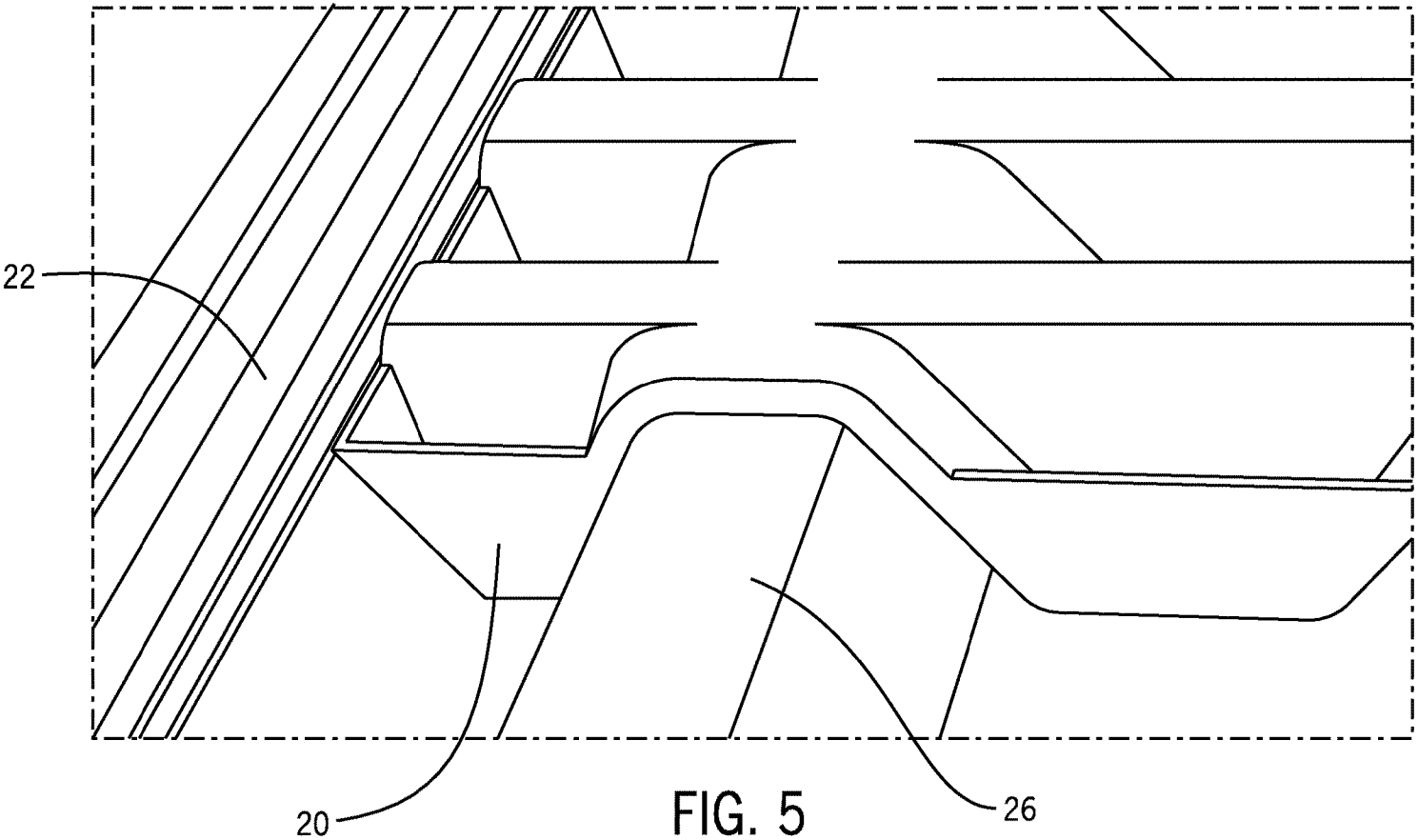
FIG. 5 is a detail perspective view of one embodiment of the present disclosure.
Figure 6:
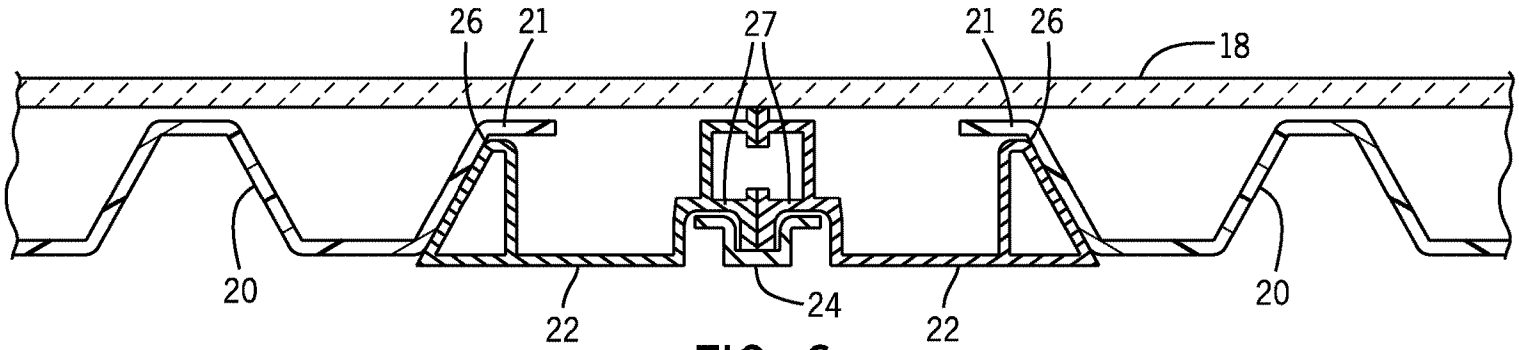
FIG. 6 is a cross sectional view of one embodiment of the present disclosure, taken along line 6-6 in FIG. 3.

Specifically, as shown in FIG. 4, the border frame member 16 may comprise a taller section with an angled surface extending away from an interior of the framed area and a border frame member tongue 17 attached to an inside surface of the border frame member 16, wherein the border frame member tongue 17 may be designed to engage with a panel frame groove 27 in the panel frame 22. As shown in FIG. 6, the panel frame 22 may engage with the grid member 24 in a similar manner, wherein the panel frame groove 27 is sized to accommodate an outer raised edge of the grid member 24, which may correspond with a grid member tongue.

The support panel 20 may comprise an egg-shell or egg-crate support panel comprising a plurality of repeating dimples having inwardly sloping walls and a flat bottom. Between adjacent dimples is defined a channel that extends along the length of the support panel 20. Each channel closest to the perimeter of the support panel 20 may define a support panel groove 21 with which either a panel frame tongue 26 or a grid member tongue may engage to secure the support panel 20 in place.

The planar surface 18 may be large enough to fill the entire interior area of the border frame 14 and cover the support panels 20. Alternatively, multiple smaller planar surfaces 18 may be used to cover the support panels 20. The planar surface may be any suitable flooring material, such as glass, tempered glass, anti-slip glass, polycarbonate, acrylic, plastic, and the like. In some embodiments, the planar surface 18 may be backlit or edge lit via built-in lights, such as fiber optic, light emitting diode (LED), or the like, operatively connected to an electrical cord 12. LED video, digital, and digital multiplex (DMX) may also be integrated in conjunction with a computer system operatively attached to the planar surface 18. The planar surface 18 may have any desired color or design printed or otherwise applied thereon.

The border frame 14, panel frames 22, and grid members 24 may be made of any desired material and, in some embodiments, comprise extruded metal. The support panel 20 may also be made of any desired material and, in some embodiments, comprises a molded plastic.

Because of the structures of the components of the interlocking flooring system 10 of the present disclosure, the system 10 may not require the use of mechanical fasteners. Rather, the system 10 may be interconnected by a tongue and groove system secured by gravity. Depending on the materials used to make the flooring system 10 and because weight is evenly distributed across the planar surface 18, the system 10 may be durable enough to support automobiles, motorcycles, recreation vehicles, and the like. The flooring system 10 may be easily installed, making it ideal for displays that need to be quickly assembled and disassembled, such as those at trade shows, in trade or show rooms, in offices, and the like. Moreover, the system 10 of the present disclosure may present no or limited tripping hazards, may not make noise when walked upon, and may have an anti-slip surface.

To use the system 10 of the present disclosure, a user may first set up the border frame 14 by creating, for example, a square with four border frame members 16. The grid members 24 may then be placed within a region defined by the border frame 14, separating the interior region into, for example, four equal grid sections. A panel frame 22 may be placed into each grid section, wherein, in the case of a system with four square grid sections, the panel frame 22 may engage with border frame members 16 along two edges and with two grid members 24 on the remaining two edges. A support panel 20 may then be placed into and engage with each panel frame 22. A planar surface 18 may then be placed on top of either the entire interior region defined by the border frame 14 or, in the case of smaller planar surfaces, on top of each grid section. When included, the electrical cord 12 may be operatively connected to a power source to power electrical components, such as lighting, mounted within the system.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An interlocking floor display system comprising:

a border frame;

a plurality of grid members positioned within the border frame and defining a grid with multiple grid sections;

a panel frame secured into each grid section;

a support panel secured within each panel frame; and a planar surface resting on top of the support panel, wherein:

the interlocking floor display system includes a tongue in groove interlocking system, eliminating the need for mechanical fasteners;

the border frame comprises a plurality of border frame members;

each border frame member comprises a border frame member tongue;

the panel frame comprises a panel frame grove along a perimeter thereof; and the border frame member tongue is positioned to engage with the panel frame groove, securing the border frame and the panel frame in place.

2. The interlocking floor display system of claim 1, wherein:

an interior edge of the panel frame comprises a panel frame tongue;

an outer edge of the support panel comprises a support panel groove; and the panel frame tongue is positioned to engage with the support panel groove to secure the panel frame and the support panel in place.

3. The interlocking floor display system of claim 1, wherein:

each grid member has a cross section, wherein a first edge of the cross section defines a first grid member tongue and a second edge of the cross section defines a second grid member tongue;

the panel frame comprises a panel frame groove along a perimeter thereof;

the panel frame groove in a first panel frame engages with the first grid member tongue; and the panel frame groove in a second panel frame engages with the second grid member tongue.

4. The interlocking floor display system of claim 1, wherein the support panel comprises an egg-crate panel comprising a plurality of repeating dimples having inwardly sloping walls and a flat bottom.

5. The interlocking floor display system of claim 1, wherein the planar surface is a member selected from the group consisting of glass, tempered glass, anti-slip glass, polycarbonate, acrylic, and plastic.

6. The interlocking floor display system of claim 1, wherein:

the border frame comprises four border frame members that form a square; and the interlocking floor display system comprises four grid members dividing an interior region defined by the border frame into four equal squares.

7. The interlocking floor display system of claim 6, wherein a single planar surface covers the entire interior region.

* * * * *